United States Patent [19]

Emery

[11] Patent Number: 4,476,932

[45] Date of Patent: Oct. 16, 1984

[54] METHOD OF COLD WATER FRACTURING IN DRAINHOLES

[75] Inventor: Leonard W. Emery, Plano, Tex.

[73] Assignee: Atlantic Richfield Company, Los Angeles, Calif.

[21] Appl. No.: 433,921

[22] Filed: Oct. 12, 1982

[51] Int. Cl.[3] ..... E21B 43/24; E21B 43/26

[52] U.S. Cl. ..... 166/303; 166/50; 166/302; 166/308

[58] Field of Search ..... 166/50, 271, 259, 302, 166/303, 308

[56] References Cited

U.S. PATENT DOCUMENTS

| | | | |
|---|---|---|---|
| 2,944,803 | 7/1960 | Hanson | 166/271 X |
| 3,398,804 | 8/1968 | Holbert | 175/61 |
| 3,465,826 | 9/1969 | Terwinger | 166/308 X |
| 3,559,737 | 2/1971 | Ralstin | 166/302 X |
| 3,835,928 | 9/1974 | Strubhar et al. | 166/308 |
| 3,863,709 | 2/1975 | Fitch | 166/271 X |
| 3,878,884 | 4/1975 | Raleigh | 166/308 X |
| 4,003,432 | 1/1977 | Paull et al. | 166/271 |
| 4,022,279 | 5/1977 | Driver | 166/308 X |
| 4,223,729 | 9/1980 | Foster | 166/271 |

OTHER PUBLICATIONS

Perkins et al., "Changes in Earth Stresses Around A Wellbore Caused by Radially Symmetrical Pressure and Temperature Gradients", SPE 10080, Oct. 5–7, 1981.

*Primary Examiner*—George A. Suchfield

*Attorney, Agent, or Firm*—Albert C. Metrailer

[57] ABSTRACT

A method for selectively positioning a fracture in a horizontal borehole comprising injection of a cooling fluid into a preselected portion of the drainhole and thereafter injection of fracturing fluid into the borehole at a pressure sufficient to initiate a fracture in the cooled portion but not in the unselected portions of the drainhole.

4 Claims, 1 Drawing Figure

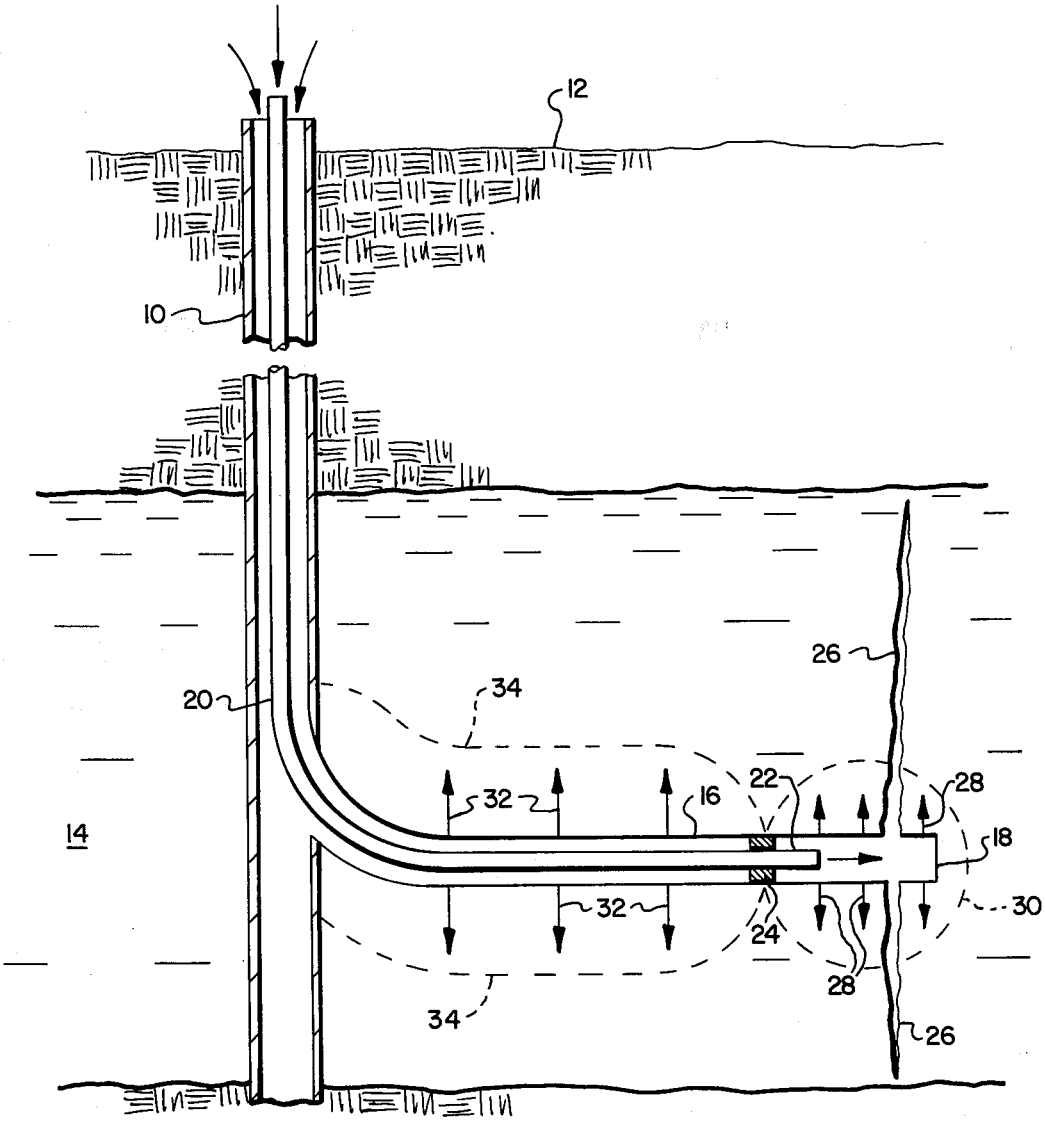
12
10
20
34
26
32
16
22
28
14
18
32
24
30
28
34
26

METHOD OF COLD WATER FRACTURING IN DRAINHOLES

BACKGROUND OF THE INVENTION

The present invention relates to generation of fractures in lateral boreholes or drainholes and more particularly, to use of a cooling fluid to selectively form fractures at optimum locations along the lateral borehole.

Numerous oil deposits have either very high viscosity or are found in formations with very low permeability. In either case, flow rates of the oil into a conventional vertical borehole are often so low that production of the oil is uneconomical. Various techniques have been used to increase the flow of oil into the main borehole. Horizontal or lateral bores have been drilled from the main borehole hundreds of feet out into the formation. U.S. Pat. No. 3,398,804 issued to Holbert illustrates apparatus and methods for drilling such horizontal boreholes or drainholes.

Hydraulic fracturing of formations surrounding the main vertical borehole has also been used to increase flow of oil into the wellbore. It is desirable that the fractures extend as far as possible from the main borehole and that they be distributed somewhat uniformly or at least selectively throughout the formation. However, fractures form preferentially along naturally occurring stress lines and, therefore, tend to grow primarily in one plane through which the borehole passes. It has, therefore, been found desirable to use drainholes for initiating fractures at points substantially displaced from the main borehole. However, drainholes are typically not cased and it is difficult to provide sufficient pressures in isolated portions of the drainhole to selectively fracture. As a result, fractures often occur close to the main vertical borehole rather than at the desired substantial distances therefrom.

It has recently been determined that formation temperatures surrounding a wellbore affect the naturally occuring earth stresses which in turn determine pressures required for fracturing the formation. See, for example, the paper entitled "Changes in Earth Stresses Around a Wellbore Caused by Radially Symmetric Pressure and Temperature Gradients" by T. K. Perkins and J. A. Gonzalez, SPE 10080, which was presented at the Fifty-sixth Annual Fall Technical Conference and Exhibition of the Society of Petroleum Engineers, Oct. 5 through 7, 1981. In this paper, it is disclosed that changes in formation temperature caused, for example, by injection of cool water in a waterflood project over a long period of time can cause substantial reduction in earth stresses and fracturing pressure in the affected formations.

SUMMARY OF THE INVENTION

Accordingly, an object of the present invention is to provide a method for selectively fracturing a formation at the outer end of a lateral borehole extending from a vertical borehole.

Yet another object of the present invention is to provide a method for enhancing the initiation and propagation of fractures from selected points along a lateral borehole extending outwardly from a vertical borehole.

A fracturing method according to the present invention includes the injection of a cooling fluid into a formation surrounding a lateral borehole and thereafter injection of a hydraulic fracturing fluid at a pressure sufficient to fracture the cooled portion of the formation. In a preferred form, hot fluid is injected into those portions of the formation surrounding the nonselected portions of the lateral borehole to provide a greater differential in fracture initiation pressures.

BRIEF DESCRIPTION OF THE DRAWING

The present invention may be better understood by reading the following detailed description of the preferred embodiments with reference to the accompanying drawing which is a cross-sectional illustration of a vertical wellbore extending into an oil-bearing formation and a lateral borehole or drainhole extending from the main borehole out into the oil producing formation.

DESCRIPTION OF THE PREFERRED EMBODIMENTS

With reference now to the FIGURE, there will be described the preferred embodiment of the present invention. In the FIGURE, there is illustrated a cased vertical wellbore 10 extending from the surface of the earth 12 to and through an oil bearing formation 14. Within formation 14, there is formed a horizontal borehole or drainhole 16 extending from well 10 out into formation 14. The outermost end or bottom 18 of drainhole 16 is preferrably positioned on the order of 100 to 300 feet from well 10. An insulated tubing 20 is provided extending from the upper end of well 10 down to and through drainhole 16 terminating at a point 22 substantially displaced from borehole 10. In this preferred embodiment, a packer 24 is provided near the end 22 of tubing 20. A fracture 26 is illustrated extending substantially vertically from drainhole 16 near its bottom 18.

After the borehole and tubing arrangements illustrated in the FIGURE have been established, the fracturing process of the present invention may be initiated. A cooling fluid is first pumped down tubing 20 and thereby into the lower end of drainhole 16 between packer 24 and its bottom end 18. Drainhole 16 is in open hole condition so that the injected fluids flow out into the formation as indicated by the arrows 28. The injected fluid is preferably at a temperature at least 20° below ambient formation temperature. It has been determined that cooling of earth formations can reduce the natural stresses by up to twenty pounds per square inch per degree Farenheit of cooling. The cooling fluid is preferably injected for a sufficient time to create a zone 30 around the lower end 18 of drainhole 16 having a temperature substantially lower than the ambient formation temperature. As a result, the fracture initiation pressure within zone 30 may be 100 to 300 pounds below the fracture initiation pressure for other portions of the formation.

While the cooling fluid is being pumped down tubing 20, it is preferred that a heating fluid having a temperature above the ambient formation temperature be injected down the annulus between tubing 20 and the borehole walls. As indicated by the arrows 32, this heating fluid is pumped out into the formation surrounding those portions of drainhole 16 lying between packer 24 and the main well 10. The warm injected fluids create a zone 34 of increased temperature relative to ambient formation temperature. The increased temperature will increase the fracture initiation pressure within zone 34. As a result of cooling the formation in zone 30 and preferably heating the formation in zone 34, that portion of drainhole 16 below packer 24 is conditioned to fracture preferentially with respect to the remaining portions of drainhole 16. Even if tubing 20 and packer 24 is removed before initiation of fracturing, it is, therefore, possible to initiate fracture 26 in the lower portion of drainhole 16 without initiating fractures in the upper portion thereof. In the preferred fracturing step, fracturing fluid is pumped into drainhole 16 at a pressure below the initiation pressure in zone 34 and above the initiation pressure in zone 30. Once the fracture 26 has been initiated, it will, as with other fractures, propagate at a lower pressure. It is, therefore, possible to extend fracture 26 beyond zone 30 without initiating fractures in zone 34. Thus, it is seen that the cooled zone 30 does not need to be as large as the desired fracture 26. This is very beneficial since a considerable quantity of fluids must be injected to significantly cool formation 14 at great distances from the drainhole 16. Since formations in which the present invention would be employed are generally of very low permeability, it takes a considerable amount of time to inject large quantities of fluid at pressures below the fracturing level.

In the normal case, the cooling and heating fluids used in the present invention would be made primarily of water. Water is generally the cheapest and most readily available injection fluid and where necessary, methods are readily available for treating available waters to avoid formation damage. The fracturing fluid will typically be any of the commercially available fluids designed specifically for the purpose. It is preferred that the fracturing fluid be chilled at least 20° below formation temperature in the same manner as the cooling water is chilled.

In many cases, it is desirable to have a series of fractures spaced at various distances away from the main borehole 10. This may be accomplished by repeating the process of the present invention at various points along drainhole 16. Thus, for example, a temporary plug could be placed at the location of packer 24 in the FIGURE and a shorter length of tubing 20 reinserted into the drainhole to terminate at a point above the temporary plug. At that point, the process would be repeated with the temporary plug acting in the same manner as the bottom 18 of drainhole 16 illustrated in the FIGURE.

While the present invention has been illustrated and described with respect to particular apparatus and methods of use, it is apparent that various modifications and changes can be made within the scope of the present invention as defined by the appended claims.

What is claimed is:

1. In a lateral borehole extending from a vertical borehole, a method for selectively forming a fracture substantially displaced from said vertical borehole comprising:

injecting a cooling fluid into the formation surrounding a selected portion of said lateral borehole substantially displaced from said vertical borehole;

injecting a warming fluid into the formation surrounding the unselected portions of said lateral borehole; and injecting a fracturing fluid into said lateral borehole at a pressure sufficient to initiate a fracture in said selected portion but not in the remaining portions of said borehole.

2. The method of claim 1 wherein said cooling and warming fluids are injected simultaneously.

3. The method of claim 1 wherein said cooling fluid is injected by means of an insulated tubing positioned in said vertical borehole and said lateral borehole extending from the earth's surface to said selected portion and a packer positioned around the lower end of said tubing to prevent return flow of said cooling fluid.

4. The method of claim 3 wherein said warming fluid is injected down the annulus between said tubing and walls of said vertical and lateral boreholes.

* * * * *